US008146659B2

(12) United States Patent
Tabary et al.

(10) Patent No.: US 8,146,659 B2
(45) Date of Patent: Apr. 3, 2012

(54) METHOD OF MODELLING ENHANCED RECOVERY BY POLYMER INJECTION

(75) Inventors: René Tabary, Saint-Germain-En-Laye (FR); Laurent Neau, Rueil-Malmaison (FR); Matthieu Olivaud, Rueil-Malmaison (FR)

(73) Assignee: IFP, Cedex (FR)

( * ) Notice: Subject to any disclaimer, the term of this patent is extended or adjusted under 35 U.S.C. 154(b) by 0 days.

(21) Appl. No.: 12/427,905

(22) Filed: Apr. 22, 2009

(65) Prior Publication Data

US 2009/0266538 A1 Oct. 29, 2009

(30) Foreign Application Priority Data

Apr. 25, 2008 (FR) ..... 08 02352

(51) Int. Cl.
*E21B 47/00* (2006.01)
*G06G 7/48* (2006.01)

(52) U.S. Cl. ..... 166/252.2; 166/250.02; 702/6; 703/10

(58) Field of Classification Search ..... None
See application file for complete search history.

(56) References Cited

U.S. PATENT DOCUMENTS 4,129,182 A * 12/1978 Dabbous ..... 166/270
4,278,128 A * 7/1981 Satter et al. ..... 166/250.16

OTHER PUBLICATIONS

Schneider, F.N. et al: "Steady-State Measurements of Relative Permeability for Polymer/Oil Systems", Society of Petroleum Engineers Journal, Feb. 1982, pp. 79-86, XP002508269.
Zheng, C. G., et al: "Effects of Polymer Adsorption and Flow Behavior on Two-Phase Flow in Porous Media", SPE 64270, Jun. 2000, pp. 216-223, XP0025508270.

* cited by examiner

*Primary Examiner* — Zakiya W Bates
(74) *Attorney, Agent, or Firm* — Antonelli, Terry, Stout & Kraus, LLP.

(57) ABSTRACT

The present invention relates to an optimized method for modelling flows in a geological hydrocarbon reservoir, comprising injecting an aqueous polymer solution to sweep the hydrocarbons, determining a relationship between a parameter linked with the mobility reduction of the solution in the reservoir and the water saturation, and accounting for this relationship in a flow simulator to achieve modelling.

8 Claims, 1 Drawing Sheet

METHOD OF MODELLING ENHANCED RECOVERY BY POLYMER INJECTION

BACKGROUND OF THE INVENTION

1. Field of the Invention

The present invention relates to oil reservoir production techniques using secondary or tertiary enhanced recovery, wherein a polymer-based fluid is injected to sweep the porous medium to improve production. The invention more particularly relates to a method of simulating this enhanced recovery technique.

2. Description of the Prior Art

Reservoir simulators are in use, such as, for example, PUMAFLOW™ (IFP) or Eclipse™ (Schlumberger) that help optimize production schemes and assess the efficiency of hydrocarbon recovery techniques. Most of these simulators integrate "Polymer" program modules that account for, among other things, the mobility reduction Rm that represents the apparent viscosity of the polymer in the reservoir, and the permeability reduction Rk. It is however known that reservoir simulators, which are computer-based, are provided with a "Polymer" option account for the mobility reduction determined in a situation of residual oil saturation (SOR).

Conventionally, polymer injection into a given porous medium (reservoir facies) in a situation of residual oil saturation (SOR) is carried out in the laboratory. The mobility reduction and the permeability reduction are thus determined for the facies being considered, and the adsorption is quantified. These parameters are determined at this saturation (SOR) by postulating that, for a mobility ratio M close to 1 ($M=k_w/\mu_w)/(k_o/\mu_o$), the dispersion of the saturation front is low and the sweep can be compared to a piston-type displacement. All of the data acquired at the end of the laboratory experiments are used as input data for the reservoir model. The various parameters are input into the simulators in a form of charts giving Rm as a function of the polymer concentration. The zero polymer concentration is given by the value of Rk.

SUMMARY OF THE INVENTION

The present invention is an optimized method of modelling flows in a geological hydrocarbon reservoir, comprising the following stages:

injecting an aqueous polymer solution to sweep the hydrocarbons;

determining a relationship between a parameter Rm linked with the mobility reduction of the solution in the reservoir and the water saturation SW; and accounting for this relationship in a computer-based flow simulator to achieve modelling.

The relationship can be obtained by laboratory measurements on rock samples from the reservoir.

BRIEF DESCRIPTION OF THE DRAWINGS

Other features and advantages of the present invention will be clear from reading the description hereafter of an embodiment given by way of non-limitative example, with reference to the accompanying figures wherein.

DETAILED DESCRIPTION OF THE INVENTION

The invention was tested for the case of a field of high oil viscosity (approximately 1600 mPa·s). The mobility ratio M, in the case of water sweep, is very unfavourable (M=160). The simulations carried out from laboratory data showed that polymer injection (aqueous solution of rheology optimized by a polymer) improves the sweep efficiency, even in the presence of mobility ratios much greater than 1. This is the situation of the field being considered where M=8, corresponding to the injection of a polymer solution of viscosity equal to 20 mPa·s. These results allowed envisaging very interesting prospects for the application of the method of enhanced recovery by injection of a polymer solution in the reservoir. A pilot test was launched in May 2005. Polymer injection started after a short stage of primary production, thus without prior water injection.

After two years' injection, the results obtained in the field show a much higher sweep efficiency of the polymer than expected from simulations. The breakthrough of the injected polymer solution occurred in the field much later than expected. The time difference was estimated at several months. The values of Rm taken into account in the simulations were those determined at the residual oil saturation (SOR).

The results obtained in the field show that the apparent viscosity of the polymer (Rm) in the reservoir was underestimated. Under the conditions of secondary recovery by polymer injection, an additional pressure drop has to be taken into account, the polymer circulating in pores whose dimensions are all the more reduced as the oil saturation is high (conditions close to SWI, then ranging between SWI and 1-SOR). This higher apparent viscosity of the polymer in the reservoir allows providing a higher sweep efficiency by decreasing the polymer aqueous phase/oil mobility ratio.

In order to validate this hypothesis, experiments were carried out to determine the mobility reduction of the polymer for different saturation states. These experiments required, on various sand masses representative of the reservoir, water/oil and polymer/oil co-injections and determination of the relative permeability profiles under steady state conditions, that is using the steady state method known to the person skilled in the art.

At a given saturation, the relative permeability ratio $k_{rwater}/k_{rpolymer}$ corresponds to a value of Rm.

Figure 1:
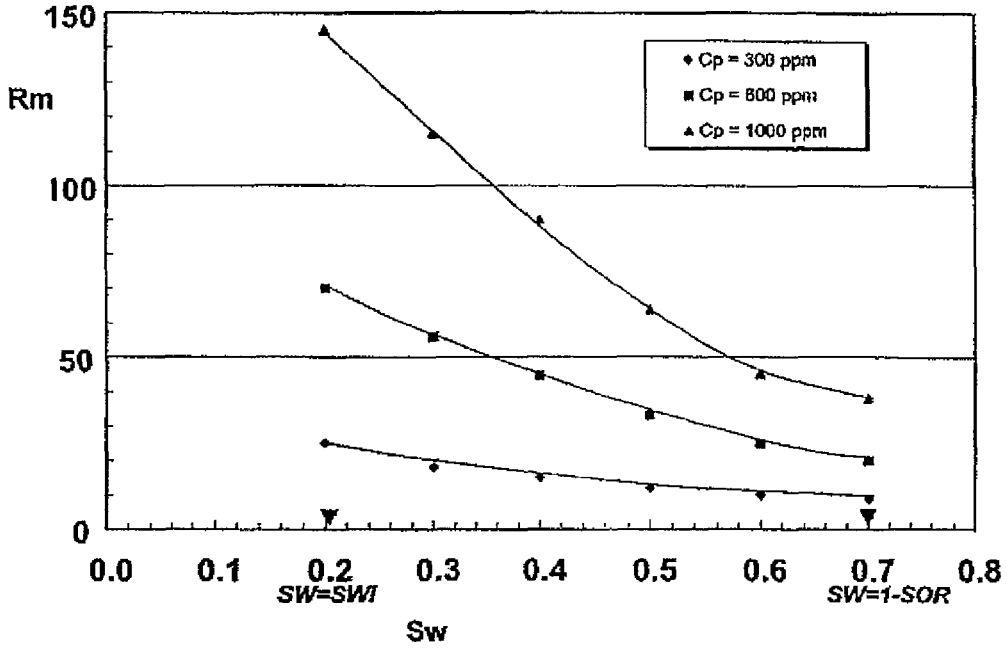
FIG. 1 illustrates the relationship between the mobility reduction Rm and the water saturation SW.

FIG. 1, which describes the mobility reduction of the polymer as a function of saturation, at constant polymer concentration, clearly shows a major effect of the saturation.

The value of SW corresponding to this residual oil saturation (SW=1-SOR) is 0.7 in the present case. A value of Rm equal to 20, for a polymer concentration of 600 ppm (corresponding to a viscosity of 15 mPa.s), corresponds to this value of SW. It can be seen that Rm increases when SW decreases and it can reach markedly high values (Rm=70) when close to the residual water saturation (SW=SWI=0.2). The effect is all the more marked as the polymer concentration is high.

Simulation tests allow comparison, in the case of the aforementioned field, the effect of an increase in the value of Rm on the time before breakthrough of the aqueous polymer phase at the producing well. A simplified first approach did not account for the variation of Rm as a function of saturation, but considered a constant value of Rm, higher than that corresponding to the value of SOR though. The simulations showed, under such conditions, a higher sweep efficiency and thus later breakthrough of the water at the producing well.

Figure 2:
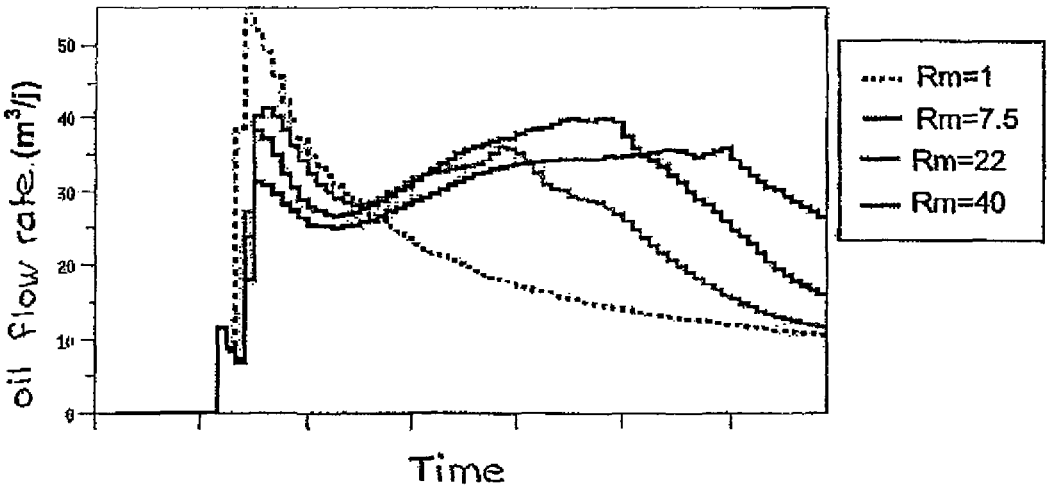
FIG. 2 shows the simulated oil production as a function of time for various apparent viscosity values (Rm).

FIG. 2 shows this simulated oil production as a function of time for different apparent viscosity values (Rm). The water breakthrough at the producing well corresponds to the decline of the oil production. The latter appears first in the case of water injection (case Rm=1). It appears all the later as the apparent viscosity (Rm) is high. Other simulations were subsequently carried out in order to evaluate the influence of the oil viscosity on the breakthrough time. It is estimated that the phenomenon is more or less marked depending on the oil viscosity, and it is probably more marked in the presence of oil of high viscosity.

The present invention concerns accounting for this saturation effect to perform a polymer sweep simulation. For a given user, such accounting requires prior laboratory tests of the type described above, unless existing charts are available.

The laboratory data are then fed into the simulator in form of tables. At each time t, a grid cell of saturation SW is assigned a value of Rm corresponding to this saturation.

This improvement in the description of the polymer physics in the simulator allows better modelling of a method of enhanced recovery by injection of a polymer-based or surfactant-based solution. It also allows advantageous reconsidering of the economics of a recovery method in a given field for which the estimation may have been minimized.

The invention claimed is:

1. A method of modelling flows in a geological hydrocarbon reservoir, comprising:

injecting an aqueous polymer solution to sweep the hydrocarbons from the reservoir;

determining a relationship between a parameter linked with mobility reduction of the solution in the reservoir and water saturation of the reservoir; and providing a flow simulation to model flows in the reservoir which accounts for the relationship.

2. A method as claimed in claim 1, wherein the relation is obtained by laboratory measurements on rock samples from the reservoir.

3. A method as claimed in claim 2, comprising:

optimizing injection parameters of injection of the solution.

4. A method as claimed in claim 3, comprising:

providing the flow simulation with a computer-based flow simulator.

5. A method as claimed in claim 2, comprising:

providing the flow simulation with a computer-based flow simulator.

6. A method as claimed in claim 1, comprising:

optimizing parameters of injection of the solution.

7. A method as claimed in claim 6, comprising:

providing the flow simulation with a computer-based flow simulator.

8. A method as claimed in claim 1, comprising:

providing the flow simulation with a computer-based flow simulator.

* * * * *